United States Patent [19]

Brookes et al.

[11] Patent Number: 4,516,770

[45] Date of Patent: May 14, 1985

[54] BALL IDENTIFICATION FOR A TABLE BALL GAME

[75] Inventors: David L. Brookes; John D. Weatherly; Colin R. Dillicar, all of Auckland, New Zealand

[73] Assignee: Development Finance Corporation of New Zealand, Auckland, New Zealand

[21] Appl. No.: 452,729

[22] Filed: Dec. 23, 1982

[51] Int. Cl.[3] ..... A63D 15/00

[52] U.S. Cl. ..... 273/11 R; 273/1 M; 273/58 G; 273/59 R

[58] Field of Search ..... 273/1 E, 1 M, 11 C, 273/11 R, 47, 48, 54 C, 58 G, 59 R, 29 R, 238; 340/323 R

[56] References Cited

U.S. PATENT DOCUMENTS

| | | | |
|---|---|---|---|
| 2,825,565 | 3/1958 | Hooker | 273/11 C |
| 3,760,404 | 9/1973 | Khlebutin | 340/323 R |
| 3,843,132 | 10/1974 | Ferguson | 273/136 A |
| 4,015,845 | 4/1977 | Sines | 273/11 C |
| 4,116,435 | 9/1978 | Sines et al. | 273/11 C |
| 4,327,920 | 5/1982 | Becker et al. | 273/238 |
| 4,355,802 | 10/1982 | Sargent | 273/11 R |
| 4,375,289 | 3/1983 | Schmall et al. | 273/29 R |
| 4,391,447 | 7/1983 | Dudley | 273/238 |

FOREIGN PATENT DOCUMENTS

| | | | |
|---|---|---|---|
| 3001924 | 7/1981 | Fed. Rep. of Germany . | |
| 566594 | 8/1977 | U.S.S.R. | 273/238 |
| 878324 | 11/1981 | U.S.S.R. | 273/238 |

*Primary Examiner*—Richard C. Pinkham
*Assistant Examiner*—MaryAnn Stoll Lastova
*Attorney, Agent, or Firm*—Young & Thompson

[57] ABSTRACT

Electronic arrangement for detecting and identifying individual balls in a table ball game involves the use of two or more distinct code elements embedded in the balls. When applied to a pool table, the balls landing in the pockets are conveyed by inclined ducts to an electronic detector coupled to a scoring device. The detector recognizes the resonant frequency of each code element and compares the codes detected with the combination of codes assigned to the different balls. The application of the invention to Kelly Pool and Poker Pool is described.

7 Claims, 9 Drawing Figures

BALL IDENTIFICATION FOR A TABLE BALL GAME

This invention relates to table ball games, such as pool, snooker, billiards, or the like, in which balls are moved on a playing surface and may pass into ball traps such as pockets around the periphery of the playing surface.

It is an object of this invention to provide electronic detection and scoring means to detect and record the passage of balls into the ball traps.

It is a further object of this invention to provide means for identifying individual balls, so that balls can be individually identified and scored.

In one aspect the invention provides a table ball game having a playing surface and ball traps, electronic detection means associated with one or more of the ball traps, a plurality of balls having identification means associated therewith and capable of being detected by said electronic detection means, wherein said electronic detection means is coupled to scoring means to record the entry of balls into said ball traps.

Providing identification means within each ball, it is possible to individually identify each ball as it passes a detector. Preferably, a single detector is mounted beneath the playing surface of the table ball game, and each ball trap or pocket has an associated chute or ducting so arranged as to pass the balls past the central detector. It will be generally convenient to provide two elements within each ball to facilitate the identification of each ball and to minimize identity errors that might occur if two balls pass the detector about the same time.

These and other aspects of this invention, which should be considered in all its novel aspects, will become apparent from the following description, which is given by way of example only, with reference to the accompanying drawings in which.

Figure 1:
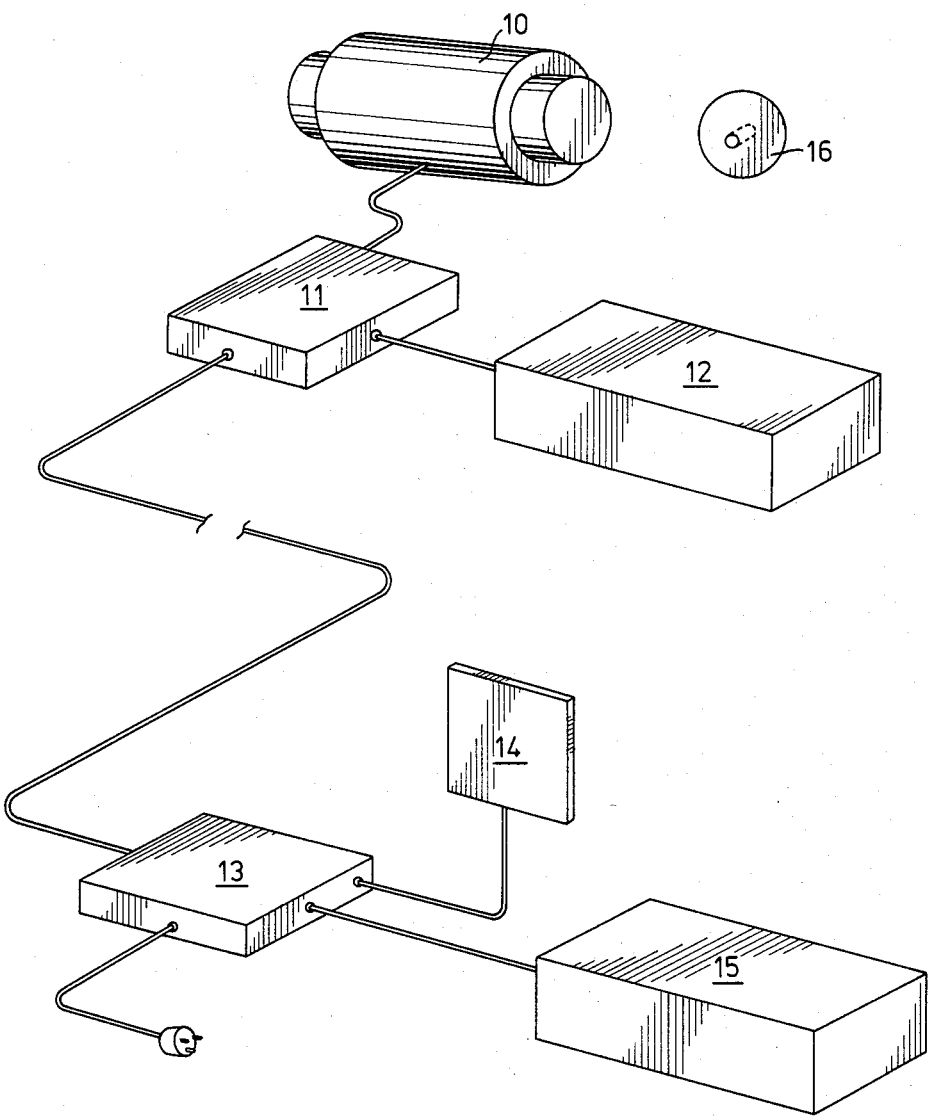
FIG. 1 is a schematic illustration of the components of this invention.

A table ball game has a ball playing surface, and a plurality of pockets for the reception of balls, each pocket having ducting associated therewith leading to a Detector Assembly 10, and a ball holding area beyond the detector.

The detector is controlled by Detector Electronics 11, which can be coupled to other table related functions 12 and a game scoring and display electronics module 13 which is in turn connected to a display 14 and other game related functions 15. For example, the table related functions 12 could include a conventional coin mechanism and means for allowing access to balls to allow the game to be played. The other game related functions could include connection to a master score board controlling several tables, means for connection to additional similar systems for championship play-off at remote locations, means for storing the highest score played, and displaying this on the display, and means for providing audio or visual messages during the course of play.

Each ball 16 has an identification capsule embedded within the ball at the time of manufacture. Preferably, the capsule contains a code with more than one element so that error checking is possible. In addition, the capsule provides impact protection for the code element.

The code elements consist of an inductance and capacitance connected together, with each code element tuned to a selected frequency. Multiple elements in each ball are each tuned to a different selected frequency and enough combinations of elements and frequencies are chosen to allow the required number of balls to be identified.

Balls pocketed during a game are ducted to pass through the Detector Assembly 10 which preferably consists of multiple coils arranged with multiple magnetic axes so that the ball orientation is unimportant.

The detector has multiple attempts to read each ball. The coils are tuned by a voltage controlled variable capacitance diode and the detector electronics control the voltage supplied to the diode in a manner that causes the detector coil to search for the frequency assigned to the code elements in the ball. The detector electronics also monitor the level of voltage in the detector coils, as the coil voltage will be at certain levels with no balls present and at different levels for selected frequencies when the code element of a selected frequency is inside the detector coil. Means are provided to sense the altered level to this to decide that a selected frequency is present.

The detector electronics looks at the selected frequencies found and recognizes them as an identification number which is distinctive for a particular ball. This information is then transmitted to the display electronics for games scoring and display purposes. Invalid combinations of frequencies are ignored.

To enable the frequencies associated with the code elements, it is preferred that the code elements have frequencies chosen from a series of n frequencies and where two or more code elements are provided in each ball, it is preferred that the frequencies assigned to each code element in the ball are different and are not adjacent to one another. For example, to be able to detect 21 different balls, 8 frequencies are selected and each ball is assigned two code elements of different frequencies. To improve frequency discrimination, adjacent selected frequencies are not used, yielding 21 possible code combinations. In the circuit illustrated in FIG. 4, the detector operates at 8 frequencies between 3.5 MHz and 6.5 MHz.

Figure 5:
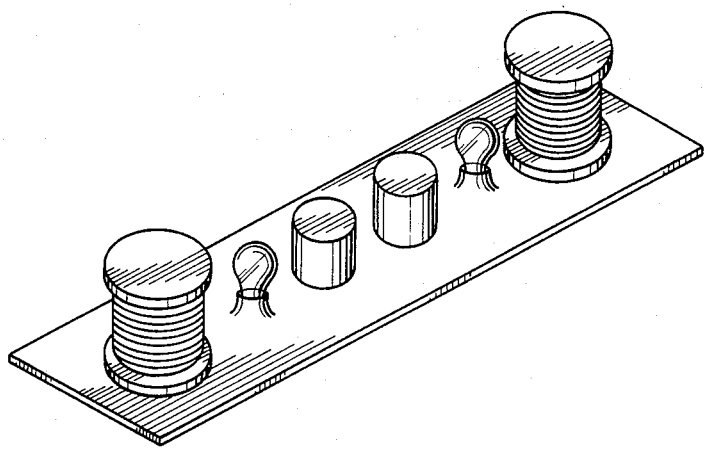
FIG. 5 illustrates the ball identification capsule.
Figure 6:
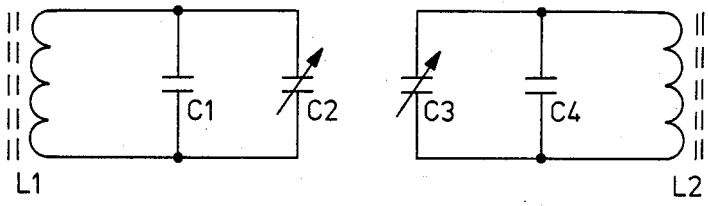
FIG. 6 is a circuit diagram of a ball identification capsule.

The ball identification capsule is shown in FIG. 5 and its circuit is shown in FIG. 6. Each capsule preferably consists of a pair of resonant circuits having an inductance L1 or L2 and conveniently, each inductance is identical and wound on a ferrite drum core, connected to fixed capacities C1 and C4 and adjustable ceramic trimmer capacitor C2 and C3 enabling each circuit to be tuned for maximum effect at its selected frequency. Once tuned, the capsule can then be sealed and encapsulated within a ball.

The detector assembly may consist of several coils, or may consist of a single coil with taps in a complex pattern to provide sensitivity at three orthogonal cartesian axes.

Figure 3:
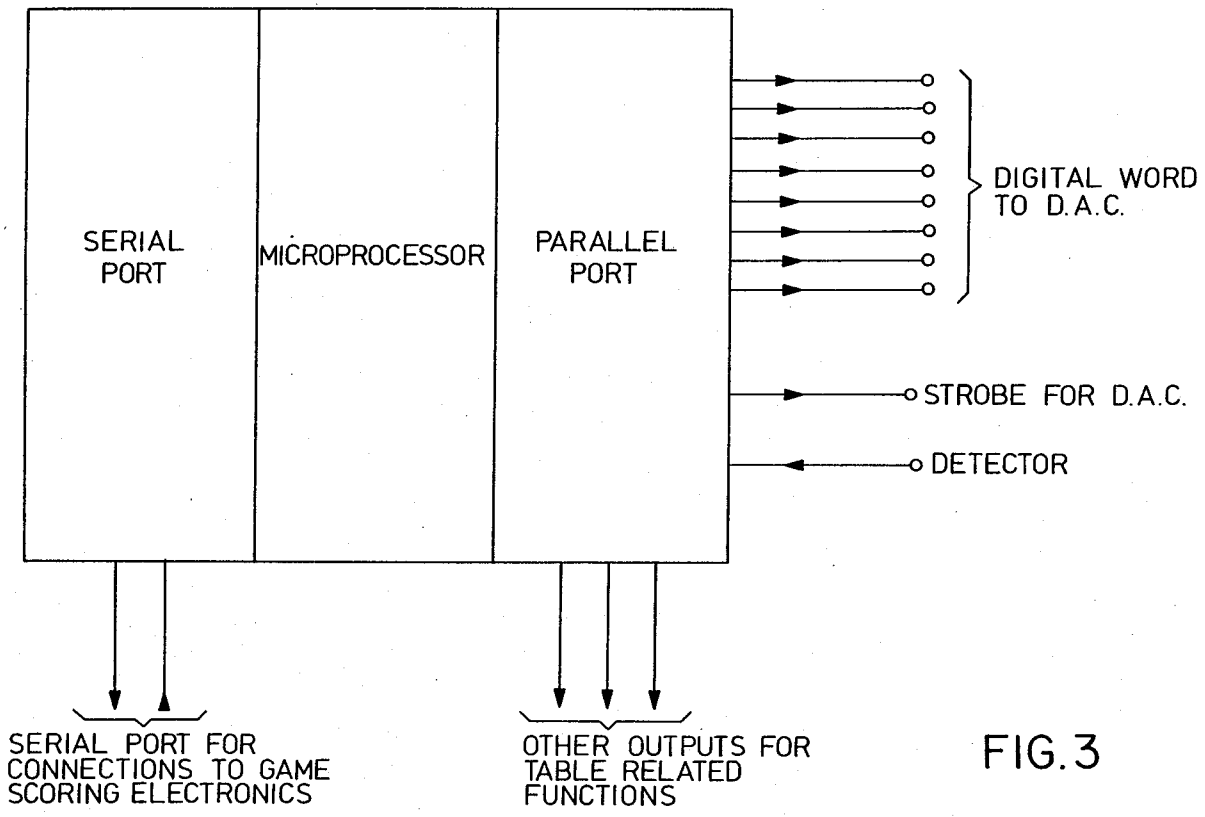
FIG. 3 is a schematic illustration of a micro processor used in controlling the detection circuit.
Figure 4A:
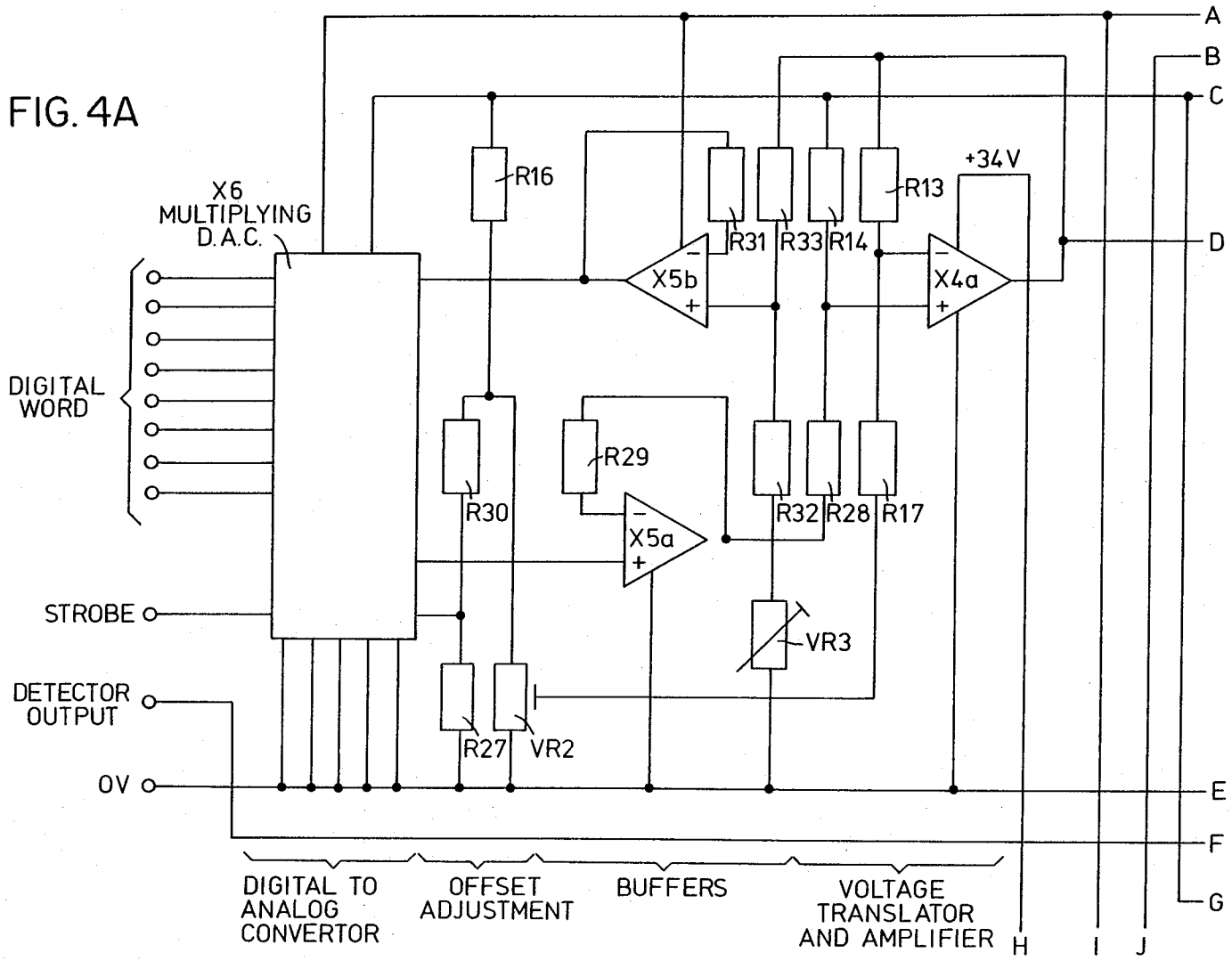
FIGS. 4A–4C show the circuit diagram of the detection circuit which is connected to the micro processor of FIG. 3.
Figure 4B:
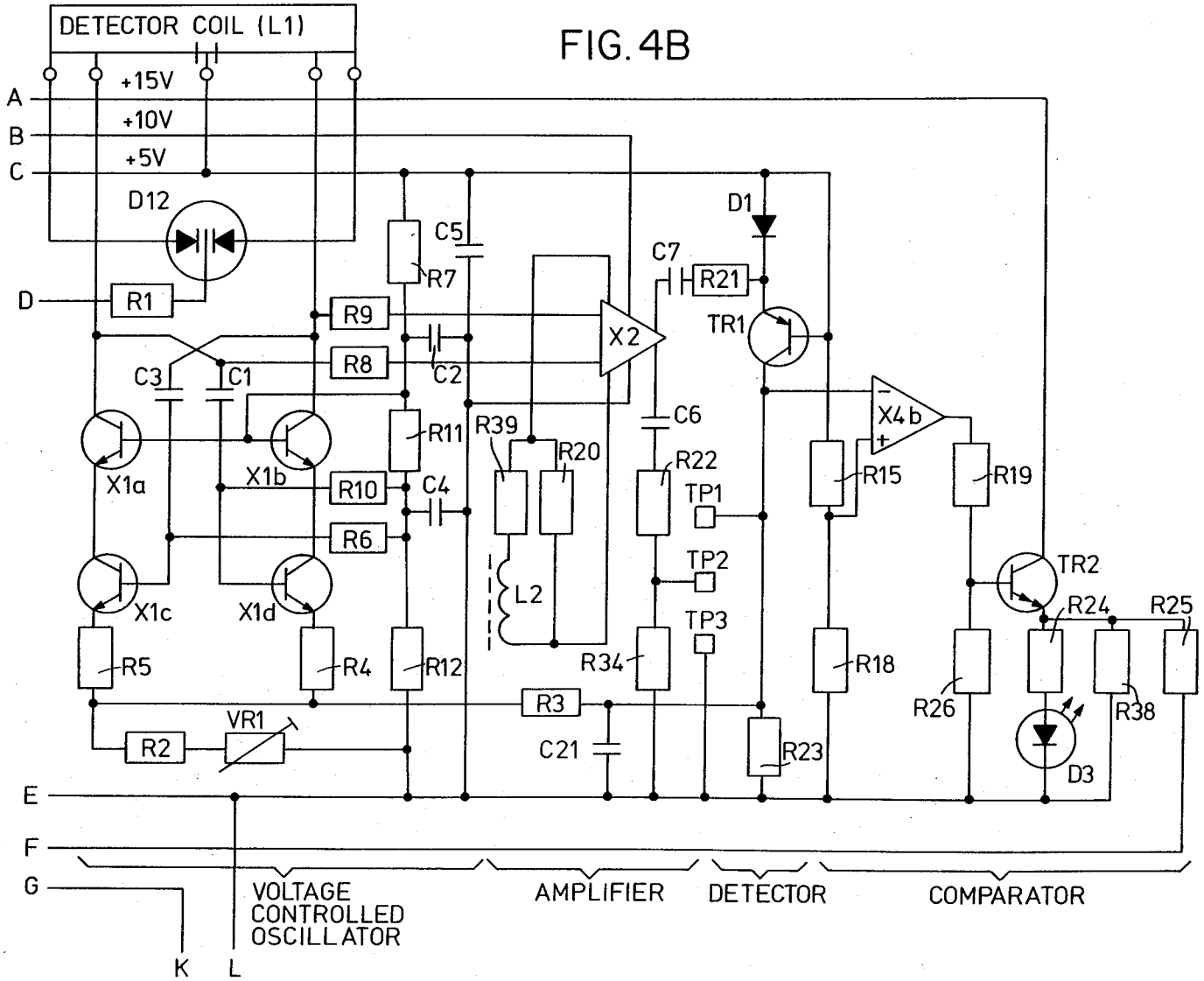
Figure 4C:
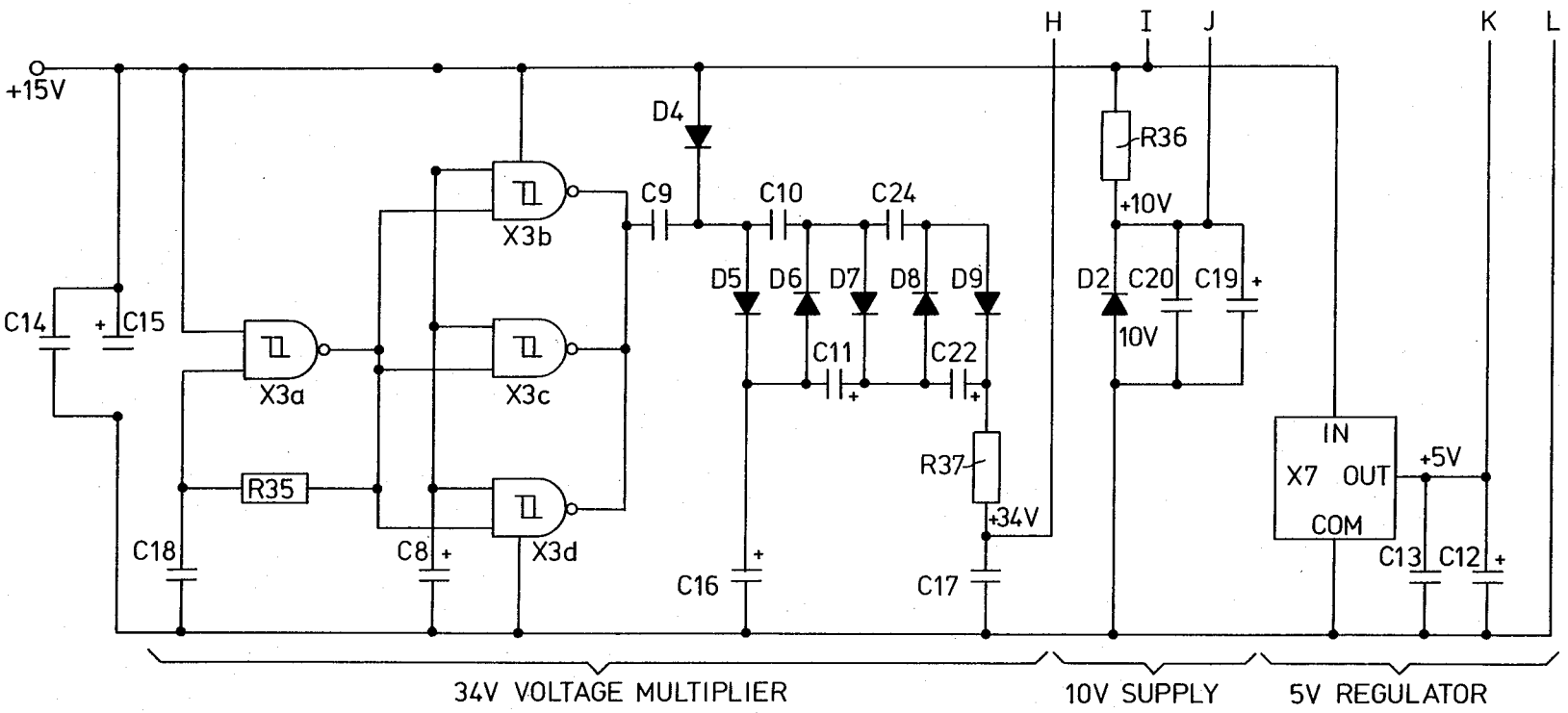

The detector circuit will now be described with reference to FIGS. 3 and 4. The micro processor of FIG. 3 presents a parallel digital word to the Digital to Analog Convertor (DAC), (X6) and operates the Strobe line to input the digital word into the DAC. The analog output from the DAC is buffered by Amplifier X5*a*. Resistors R16,R30,R27 provide a minimum analog voltage to the DAC, while Amplifier X5*b* provides a maximum analog voltage to the DAC. The output from Amplifier X5*a* is defined within these voltages as a function of the digital word.

The voltage difference between Amplifier X5*a* and Variable Resistance VR2 is fed to Amplifier X4*a*. Voltage and other values given in this circuit are given by way of example only to facilitate illustration of the operation of the circuit. A proportion of the output from Amplifier X4*a* is fed back to the DAC via resistors R33, R32, VR3 and the buffer amplifier X5*b*, to cause a multiplying action on the relationship of the output from the Amplifier X4*a* to the digital word.

The output from Amplifier X4*a* also provides the tuning diode D12 with a bias voltage that controls the tuning diode capacitance.

Detector Coil L1, and Tuning Diode D12 form a tuned resonant circuit with oscillation maintained by coupling capacitors C1, C3 and transistors X1*c*, X1*d*. DC bias conditions for the transistors X1*c*, X1*d*, are controlled by resistors R2, R4, R5, R6, R10, VR1 and Voltage Divider Chain R7, R11, R12. Resistors R4, R5 cause current sharing at low current levels whilst Variable Resistors VR1 sets the oscillator activity level. Transistors X1*a* and X1*b* are connected in common base configuration to reduce transistor loading effects on the coil L1.

Amplifier X2 monitors the oscillation level of the detector coil and provides amplification to drive Detector D1, TR1. the detector output is developed across Resistor R23 (at Test Point TP1) and is smoothed by Capacitor C21, and part of it is fed via Resistors R3, R2, VR1 to control the oscillator maximum level. The amplifier gain is controlled by the network R20, R39, L2, which also provides limited frequency emphasis, and via R3 provides a leveling effect at the detector as the frequency is varied. Resistors R8, R9, isolate amplifier input loading effects from the detector coil. Amplifier X2 has two complementary outputs, one being used to drive the detector while the other drives an output suitable for connecting to a counter (at TP2) to show the detector coil frequency during set up procedures.

Amplifier X4*b* is used as a comparator, with its output going high when its inverting input, connected to the detector output (at TP1), goes lower than the voltage input at the junction of R15, R18. The comparator output is divided down by R19, R26 and fed to Darlington transistor TR2 which provides enough current to light LED D3 for visible indication of detection, and to provide the output signal to the microprocessor via R25. Resistor R38 is connected across the transistor output to insure a low level when TR2 is off.

The microprocessor provides 15 volts DC to the detector and three other voltages can be generated in the power supply section of the electronics. 5 volts is generated by an integrated circuit linear regulator X7. 10 volts is generated by a Zener diode shunt regulator D2 and used to supply amplifier X2.

The 34 volt bias voltage for the tuning diode is generated by a voltage multiplier connected to the output of a CMOS Schmitt trigger integrated circuit, with one section as an oscillator and three sections paralleled as a driver.

Figure 2:
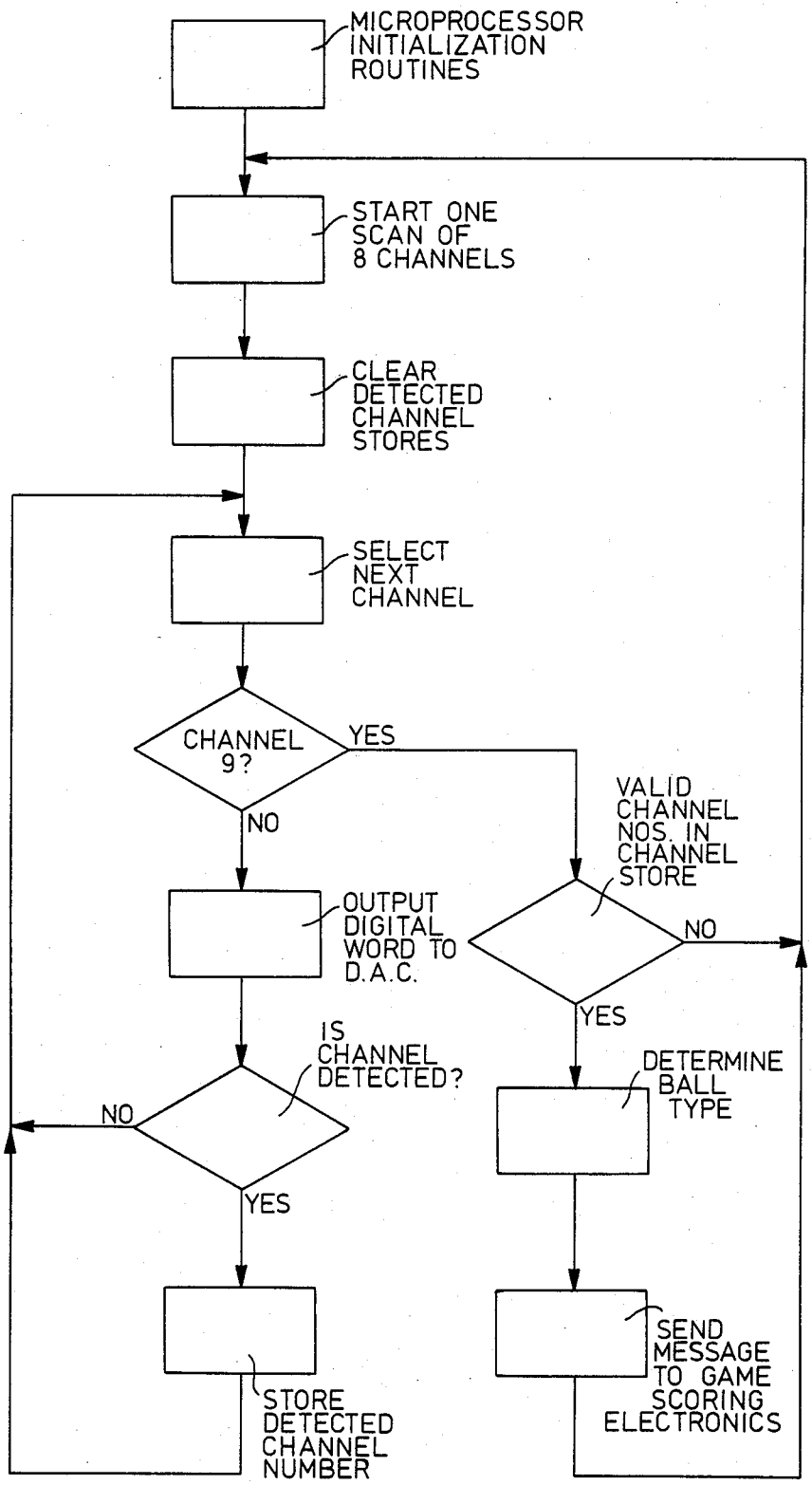
FIG. 2 illustrates a flow chart for the control of the detection circuitry.

The operation of the microprocessor is shown by the flow chart in FIG. 2 and shows how the digital words are generated and fed in series to the digital to analog converter which generates a voltage which is applied to the tuning diode which causes the oscillator frequency to move to the selected frequencies under control of the value of the digital word. This action tests for each of the selected eight frequencies in rapid and cyclic succession. While each frequency is being output, the detector is checked for response and if two valid frequencies are found, the ball is recognized and its identification is then passed to the game scoring electronics.

Figure 7:
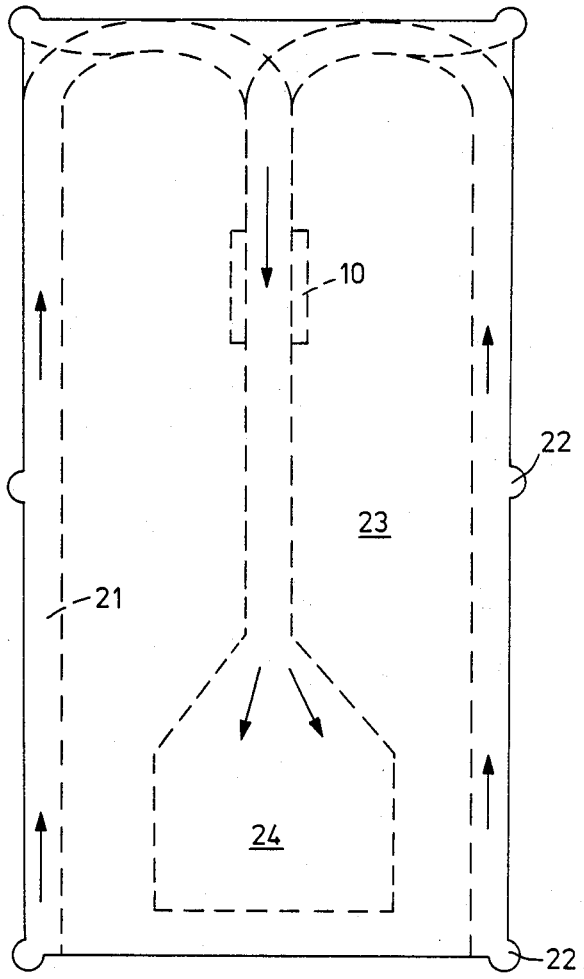
FIG. 7 shows the general arrangement of ball chutes and detector.

FIG. 7 shows the general arrangement of chutes 21 from the pockets 22. These chutes lie beneath the playing surface 23 and are inclined so as to allow balls 16 to travel towards the detector 10 and then to a ball holding area 24 which may be coupled to a coin release mechanism enabling balls to be released at the commencement of a game.

The application of this invention to pool games such as Kelly Pool and Poker Pool will now be described.

For each game, the sequence of events will be basically as follows:

(a) Player or team leader enters his name or code on a keyboard and electronic display on the wall unit, to book a turn at the table, (b) The entry is acknowledged, and position in the current queue is signalled.

(c) Each time the table is vacated, the board audibly calls the next players, and displays their name, or code on a separate display.

(d) If the players called, do not respond by inserting coins within a predetermined time, the next group is called.

(e) The teams or partners playing select either of two games, by pushing an appropriate pushbutton at the table.

(f) The coins are monitored, and when the correct amount has been paid (e.g. 1×50 c coin for Kelly Pool, and 2×50 c coins for Poker Pool), the appropriate sets of balls are dropped).

(g) Generally one person will be responsible for scoring, and it will be his/her responsibility to press one or the other of two pushbuttons on the table, to indicate which team or player is currently playing.

(h) The game progresses, the cue ball being returned after pocketing, until all the other balls have been pocketed. If the winning team is decided prior to this, the remaining balls will need to be pocketed to signal the game completion.

KELLY POOL

This game is the standard game, as played universally.

There are 16 balls associated with the game, including the cue ball. Balls fall into two groups, commonly unders and overs (under 8 or over 8) and are numbered, or otherwise identified to separate groups.

Each player or team of two, attempts to pot their balls ahead of the other, finally potting the black or "wild" ball (No. 8).

In the electronic version, the ball numbers will be displayed on the panel in two groups, unders and overs.

Fifteen balls need to be identified, the balls and their identification method, can be similar to that used in Poker Pool, as both games will not be played simultaneously.

However, the balls should be visually distinct from those used in Poker Pool.

POKER POOL

There are 22 balls in the game, and these are notated in the four suits of common playing cards, from the "10" card up to the "Ace" card.

There is also a "Joker" ball (which is wild) and the cue ball, which is traditionally white, but another color could be introduced. Therefore the balls are notated thus:

| | Identification |
|---|---|
| Hearts | |
| 10 | 1 |
| J | 2 |
| Q | 3 |
| K | 4 |
| A | 5 |
| Diamonds | |
| 10 | 6 |
| J | 7 |
| Q | 8 |
| K | 9 |
| A | 10 |
| Clubs | |
| 10 | 11 |
| J | 12 |
| Q | 13 |
| K | 14 |
| A | 15 |
| Spades | |
| 10 | 16 |
| J | 17 |
| Q | 18 |
| K | 19 |
| A | 20 |
| Joker | 21 |
| Cue Ball | None |

Each team takes turns to selectively pocket balls, in such a way that they are assisted to gain a Poker hand, or their opponents are prevented from doing so.

The Joker is a wild ball, and is the last ball to be pocketed.

The cue ball is returned when pocketed, and does not have any effect on the score.

Whenever a ball is pocketed, a corresponding indicator panel on the wall display unit is lit, in the group of indicators associated with each player or team.

Each group of indicators is laid out in suits, with graphical display of the corresponding card in front.

| | | | | | | |
|---|---|---|---|---|---|---|
| e.g.: | SPADE | 10 | J | Q | K | A |
| | CLUB | 10 | J | Q | K | A |
| | DIAMOND | 10 | J | Q | K | A |
| | HEART | 10 | J | Q | K | A |
| | | | | J | | |

So that the correct group of indicators can be lit, one or the other of two "team select" pushbuttons are pushed, at the commencement of each teams turn.

In really serious games a referee will be appointed to attend to this function, together with rule interpretation, but normally players will monitor this themselves.

In the case of Poker Pool, a preferred indicator panel involves the use of electronically controlled flip cards, each card being provided with the appropriate graphics to represent a designated card corresponding to the balls, so that when that particular ball is pocketed, the ball will be recognized by the detector electronics which will then cause the appropriate flip card to flip over presenting the appropriate graphics indicating that that ball has been scored.

While the circuit of this invention has been described with particular reference to the scoring of balls in different types of pool games, it will be appreciated that the invention can be used in any table ball game in which the passage of balls into ball traps is to be scored. Although the preferred arrangement utilizes passive resonant circuits embedded within the ball, other identification means could be used including active circuits, optical characteristics, magnetic identify capsules, or any other identification means which could be read by detection means and provide an output to scoring means.

Finally, it will be appreciated that various alterations and modifications may be made to the foregoing without departing from the spirit or scope of this invention as exemplified by the following claims.

We claim:

1. A table ball game having a playing surface and ball traps, electronic detection means associated with one or more of the ball traps, a plurality of balls having identification means associated therewith, said identification means comprising at least one resonant circuit in each said ball, said at least one circuit in each said ball being tuned to resonate at a different frequency than at least one said circuit in each of the other said balls, said at least one circuit of each said ball being capable of being individually detected by said electronic detection means, said electronic detection means being coupled to scoring means to record the entry of balls into said ball traps, the electronic detection means comprising plural coils or a single coil with taps in a complex pattern, either of these coil means arranged to generate a complex field having a plurality of orthogonal axes, and means for detecting perturbations in said field.

2. A table ball game as claimed in claim 1, wherein said ball traps are connected to ducting, and wherein said electronic detection means consists of a detector capable of detecting the identity of each of said balls passing along said ducting.

3. A table ball game as claimed in claim 2, wherein said detection means includes detection coils mounted around said ducting and having sensitivity to three orthogonal cartesian axes.

4. A table ball game as claimed in claim 1 wherein said detector is controlled by a microprocessor which provides a series of digital words which are loaded into a digital to analog converter to provide a voltage which is applied to an oscillator to provide the appropriate frequency within the detection coil.

5. A table ball game having a playing surface and ball traps, electronic detection means associated with one or more of the ball traps, a plurality of balls having identification means associated therewith and capable of being individually detected by said electronic detection means, wherein said electronic detection means is coupled to scoring means to record the entry of balls into said ball traps, the electronic detection means comprising a complex field having a plurality of axes, and means for detecting perturbations in said field, said ball traps being connected to ducting, said electronic detection means consisting of a detector capable of detecting the identity of each of said balls passing along said ducting, said identification means consists of a passive electrical circuit embedded within a ball, each said ball containing an identification capsule consisting of a plurality of resonant circuits, each resonant circuit within a particular ball being tuned to resonate at a different frequency than the other resonant circuit or circuits embedded within that ball.

6. A table ball game as claimed in claim 5, wherein each identification capsule consists of a pair of resonant circuits, each circuit being tuned to a particular one of n frequencies chosen from a series of n frequencies with the two resonant circuits within each ball being tuned to different and non-adjacent frequencies to improve frequency discrimination during detection.

7. A table ball game as claimed in claim 5 wherein the electronic detector includes means for scanning the n frequencies assigned to the identification means, means for detecting the presence of any one of the n frequencies, means for comparing the frequency combinations detected with valid combinations assigned to the balls, and if a valid combination is detected transmitting a recognition and scoring signal to said scoring means.

* * * * *